US007296756B2

(12) United States Patent
Scharfenberger

(10) Patent No.: US 7,296,756 B2
(45) Date of Patent: Nov. 20, 2007

(54) VOLTAGE BLOCK

(75) Inventor: James A. Scharfenberger, Indianapolis, IN (US)

(73) Assignee: Illinois Tool Works Inc., Glenview, IL (US)

( * ) Notice: Subject to any disclaimer, the term of this patent is extended or adjusted under 35 U.S.C. 154(b) by 345 days.

(21) Appl. No.: 11/135,626

(22) Filed: May 23, 2005

(65) Prior Publication Data

US 2006/0273185 A1 Dec. 7, 2006

(51) Int. Cl.
*B05B 5/025* (2006.01)

(52) U.S. Cl. ..... 239/3; 239/112; 239/304; 239/305; 239/690; 239/708; 118/621; 137/625.43

(58) Field of Classification Search ..... 239/3, 239/104, 112, 303–305, 690, 699, 700, 708; 118/621, 627, 6; 137/625.2, 625.43
See application file for complete search history.

(56) References Cited

U.S. PATENT DOCUMENTS

| | | | |
|---|---|---|---|
| 3,851,618 | A | 12/1974 | Bentley |
| 3,875,892 | A | 4/1975 | Gregg et al. |
| 3,894,272 | A | 7/1975 | Bentley |
| 3,933,285 | A | 1/1976 | Wiggins |
| 3,937,400 | A | 2/1976 | Krause |
| 4,017,029 | A | 4/1977 | Walberg |
| 4,020,866 | A | 5/1977 | Wiggins |
| 4,075,677 | A | 2/1978 | Bentley |
| 4,085,892 | A | 4/1978 | Dalton |
| 4,187,527 | A | 2/1980 | Bentley |
| 4,275,834 | A | 6/1981 | Spanjersberg et al. |
| 4,313,475 | A | 2/1982 | Wiggins |
| 4,324,812 | A | 4/1982 | Bentley |
| 4,337,282 | A | 6/1982 | Springer |
| 4,383,644 | A | 5/1983 | Spanjersberg et al. |
| 4,481,557 | A | 11/1984 | Woodruff |
| 4,485,427 | A | 11/1984 | Woodruff et al. |
| 4,745,520 | A | 5/1988 | Hughey |
| 4,771,729 | A | 9/1988 | Planert et al. |
| 4,792,092 | A | 12/1988 | Elberson et al. |
| 4,878,622 | A | 11/1989 | Jamison et al. |
| 4,879,137 | A | 11/1989 | Behr et al. |
| 4,884,752 | A | 12/1989 | Plummer |
| 4,921,169 | A | 5/1990 | Tilly |
| 4,932,589 | A | 6/1990 | Diana |
| 4,982,903 | A | 1/1991 | Jamison et al. |
| 5,033,942 | A | 7/1991 | Petersen |
| 5,078,168 | A | 1/1992 | Konieczynski |
| 5,094,389 | A | 3/1992 | Giroux et al. |
| 5,096,126 | A | 3/1992 | Giroux et al. |

(Continued)

FOREIGN PATENT DOCUMENTS

| | | | |
|---|---|---|---|
| GB | 2 166 982 | A | 5/1986 |

(Continued)

*Primary Examiner*—Steven J. Ganey
(74) *Attorney, Agent, or Firm*—Barnes & Thornburg LLP

(57) ABSTRACT

A voltage block comprises first and second reservoirs and a switching device including an inlet port, an outlet port, a first reservoir port and a second reservoir port. The switching device is mounted in a third reservoir for movement between a first position and a second position. The third reservoir includes an electrically non-conductive fluid medium in which at least a portion of the switching device is immersed.

20 Claims, 3 Drawing Sheets

U.S. PATENT DOCUMENTS 5,102,045 A * 4/1992 Diana ..... 239/112
5,102,046 A * 4/1992 Diana ..... 239/3
5,159,544 A 10/1992 Hughey et al.
5,193,750 A 3/1993 LaMontagne et al.
5,197,676 A 3/1993 Konieczynski et al.
5,208,078 A 5/1993 Ishibashi et al.
5,221,194 A 6/1993 Konieczynski et al.
5,255,856 A 10/1993 Ishibashi et al.
5,271,569 A 12/1993 Konieczynski et al.
5,288,029 A * 2/1994 Ishibashi et al. ..... 239/690
5,326,031 A 7/1994 Konieczynski
5,340,289 A 8/1994 Konieczynski et al.
5,341,990 A 8/1994 Konieczynski
5,518,186 A 5/1996 Weinstein
5,526,986 A 6/1996 Padgett et al.
5,538,186 A 7/1996 Konieczynski
5,549,755 A 8/1996 Milovich et al.
5,632,816 A 5/1997 Allen et al.
5,655,896 A 8/1997 Konieczynski
5,707,013 A 1/1998 Konieczynski
5,725,150 A 3/1998 Allen et al.
5,727,931 A 3/1998 Lash et al.
5,737,174 A 4/1998 Konieczynski
5,746,831 A 5/1998 Allen et al.
5,759,277 A 6/1998 Milovich et al.
5,787,928 A 8/1998 Allen et al.
RE35,883 E 9/1998 Konieczynski
5,944,045 A 8/1999 Allen et al.
5,978,244 A 11/1999 Hughey
6,021,965 A 2/2000 Hartle
6,144,570 A 11/2000 Hughey
6,423,142 B1 7/2002 Hughey
6,423,143 B1 7/2002 Allen et al.
6,562,137 B2 5/2003 Hughey

FOREIGN PATENT DOCUMENTS

JP 54-101843 8/1979
JP 3-178354 8/1991
JP 4-66149 3/1992
JP 4-200662 7/1992
JP 4-267961 9/1992
JP 5-154638 6/1993
JP 51-54638 6/1993
JP 6-198228 9/1994
JP 7-88407 4/1995
WO WO 2005/014178 A1 2/2005

* cited by examiner

FIG. 2
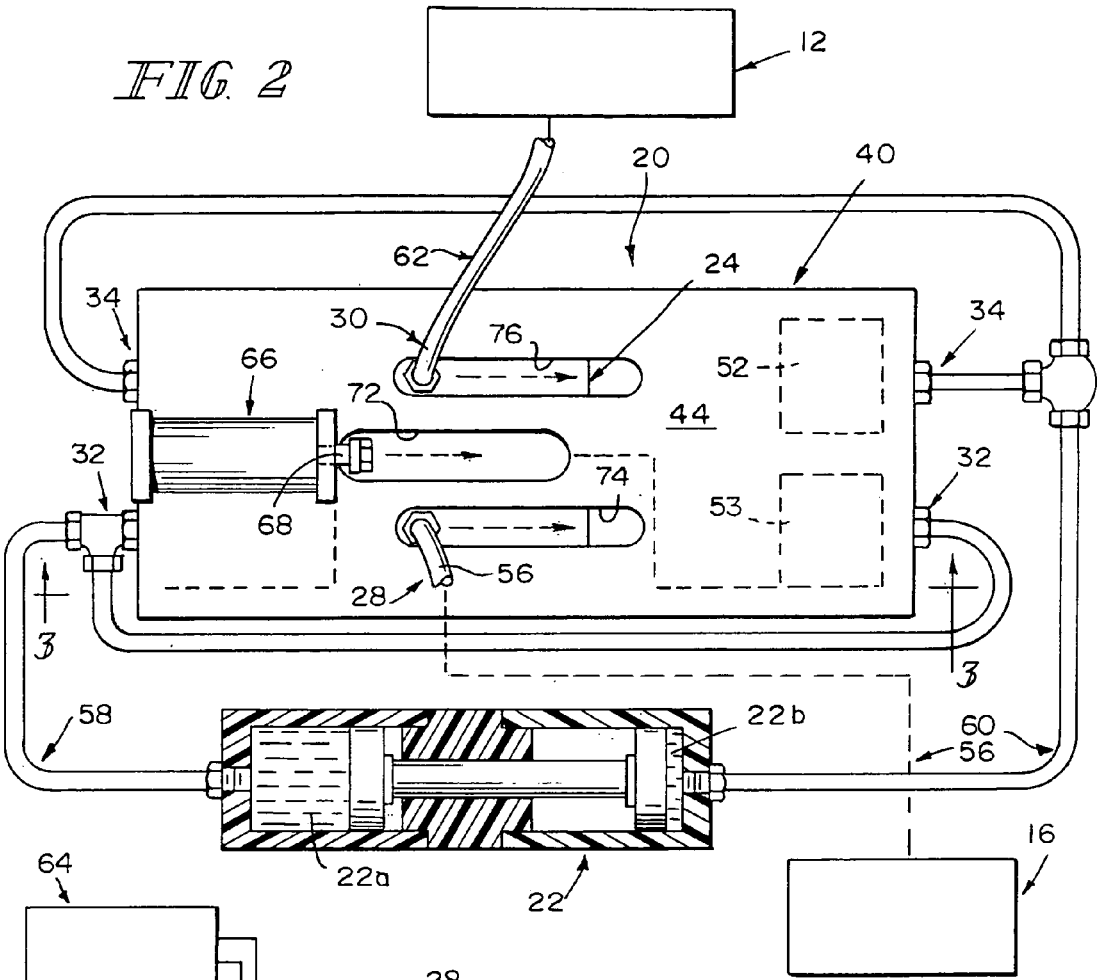
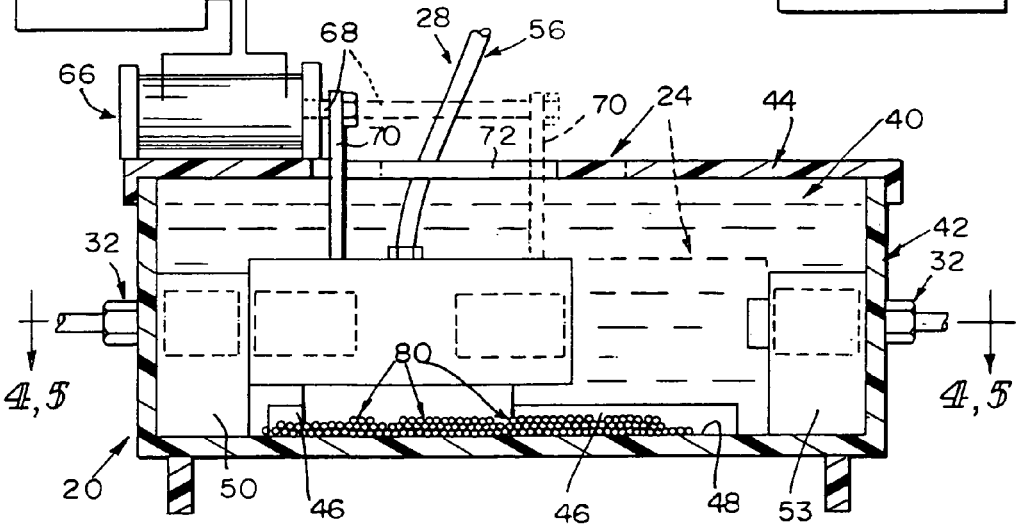
FIG. 3

VOLTAGE BLOCK

FIELD OF THE INVENTION

This invention relates to devices for electrically isolating coating dispensing equipment which is maintained at high-magnitude electrostatic potential from coating material sources supplying the coating dispensing equipment. Such devices are commonly known, and are generally referred to hereinafter, as voltage blocks.

BACKGROUND OF THE INVENTION

Various types of voltage blocks are known. There are, for example, the devices and systems described in the following U.S. Pat. Nos. 6,423,143; 6,021,965; 5,944,045; RE35,883; 5,787,928; 5,759,277; 5,746,831; 5,737,174; 5,727,931; 5,725,150; 5,707,013; 5,655,896; 5,632,816; 5,549,755; 5,538,186; 5,526,986; 5,518,186; 5,341,990; 5,340,289; 5,326,031; 5,288,029; 5,271,569; 5,255,856; 5,221,194; 5,208,078; 5,197,676; 5,193,750; 5,096,126; 5,094,389; 5,078,168; 5,033,942; 4,982,903; 4,932,589; 4,921,169; 4,884,752; 4,879,137; 4,878,622; 4,792,092; 4,771,729; 4,383,644; 4,313,475; 4,275,834; 4,085,892; 4,020,866; 4,017,029; 3,937,400; and, 3,933,285; as well as WO 2005/014178; GB2,166,982; JP4-267961; JP4-200662; JP7-88407; JP51-54638; JP54-101843; JP4-66149; JP3-178354; JP3217394 and, JP3378058. U.S. Pat. No. 4,337,282 is also of interest. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a voltage block comprises first and second reservoirs and a switching device including an inlet port, an outlet port, a first reservoir port and a second reservoir port. The switching device is mounted in a third reservoir for movement between a first position and a second position. The third reservoir includes an electrically non-conductive fluid medium in which at least a portion of the switching device is immersed.

Illustratively according to this aspect of the invention, the voltage block includes first, second, third and fourth valves. The first, second, third and fourth valves are immersed in the electrically non-conductive fluid medium.

Illustratively according to this aspect of the invention, the first and second reservoirs comprise piston-and-cylinder fluid motors.

Illustratively according to this aspect of the invention, the first and second reservoirs together comprise a double-acting, piston-and-cylinder fluid motor.

Illustratively according to this aspect of the invention, the third reservoir comprises a tank including a track to which the switching device is mounted for movement between the first and second positions.

Illustratively according to this aspect of the invention, when the switching device is in the first position, the first valve couples the inlet port to the first reservoir port and the second valve couples the second reservoir port to the outlet port, and when the switching device is in the second position, the third valve couples the inlet port to the second reservoir port and the fourth valve couples the first reservoir port to the outlet port.

Illustratively according to this aspect of the invention, the third reservoir includes means for movably mounting the switching device. The voltage block further includes means for moving the switching device between the first and second positions.

Further illustratively according to this aspect of the invention, the voltage block comprises molecular sieves in the third reservoir for separating a component it is desired to remove from the electrically non-conductive fluid medium.

Additionally illustratively according to this aspect of the invention, the molecular sieves are renewable.

According to another aspect of the invention, the voltage block appears in combination in a coating dispensing system with a coating material source, a coating dispensing device, a high magnitude electrostatic potential source. A first conduit couples the source and the inlet port. A second conduit couples the first reservoir and first reservoir port. A third conduit couples the second reservoir and second reservoir port. A fourth conduit couples the outlet port and the coating dispensing device.

According to another aspect of the invention, a method of coating an article comprises providing first and second reservoirs and providing a switching device. An inlet port, an outlet port, a first reservoir port and a second reservoir port are provided on the switching device. The method further includes providing a third reservoir including an electrically non-conductive fluid medium. The switching device is mounted in the third reservoir for movement between a first position and a second position. The switching device is at least partially immersed in the electrically non-conductive fluid medium in the third reservoir.

Illustratively according to this aspect of the invention, providing a switching device and providing a third reservoir together include providing first, second, third and fourth valves. At least partially immersing the switching device in the electrically non-conductive fluid medium in the third reservoir includes immersing the first, second, third and fourth valves in the electrically non-conductive fluid medium.

Illustratively according to this aspect of the invention, providing first and second reservoirs comprises providing piston-and-cylinder fluid motors.

Illustratively according to this aspect of the invention, providing first and second reservoirs together comprises providing a double-acting, piston-and-cylinder fluid motor.

Illustratively according to this aspect of the invention, providing the third reservoir comprises providing a tank including a track. Providing the switching device includes mounting the switching device on the track for movement between the first and second positions.

Illustratively according to this aspect of the invention, the method further includes coupling the inlet port to the first reservoir port through the first valve and coupling the second reservoir port to the outlet port through the second valve when the switching device is in the first position, and coupling the inlet port to the second reservoir port through the third valve and coupling the first reservoir port to the outlet port through the fourth valve when the switching device is in the second position.

Further illustratively according to this aspect of the invention, the method includes movably mounting the switching device and moving the switching device between the first and second positions.

Illustratively according to this aspect of the invention, the method further comprises providing molecular sieves in the third reservoir for separating a component it is desired to remove from the electrically non-conductive fluid medium.

Additionally illustratively according to this aspect of the invention, the method further comprises renewing the molecular sieves.

According to another aspect of the invention, the method includes providing a coating material source, a coating dispensing device, and a high magnitude electrostatic potential source, coupling the source and the inlet port, coupling the first reservoir and first reservoir port, coupling the second reservoir and second reservoir port, and coupling the outlet port and the coating dispensing device.

BRIEF DESCRIPTION OF THE DRAWINGS

The invention may best be understood by referring to the detailed description and accompanying drawings which illustrate the invention. In the drawings:

FIG. 2 illustrates an enlarged, partly plan and partly sectional view of certain components of the system illustrated in FIG. 1;

FIG. 3 illustrates a partly sectional side elevational view of the components illustrated in FIG. 2, taken generally along section lines 3-3 thereof;

DETAILED DESCRIPTIONS OF ILLUSTRATIVE EMBODIMENTS

As used in this application, terms such as "electrically conductive" and "electrically non-insulative" refer to a broad range of conductivities electrically more conductive than materials described as "electrically non-conductive" and "electrically insulative." Terms such as "electrically semiconductive" refer to a broad range of conductivities between electrically conductive and electrically non-conductive.

Figure 1:
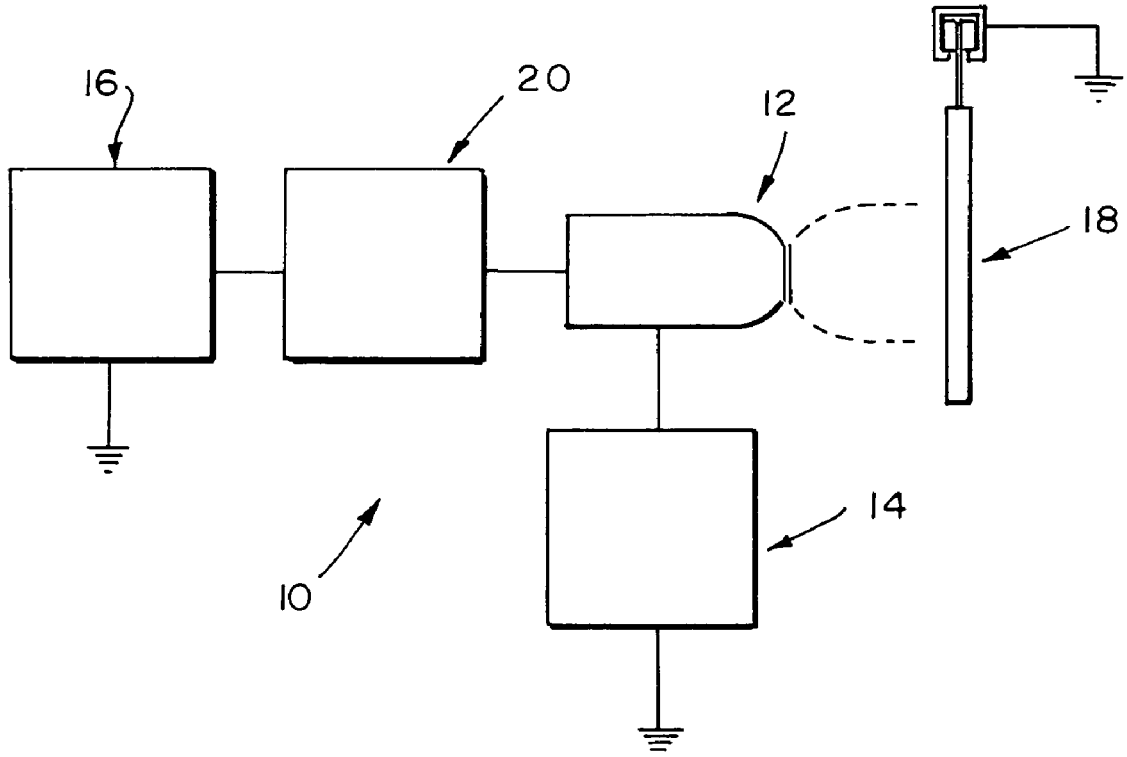
FIG. 1 illustrates a partly block and partly schematic diagram of a system constructed according to the present invention.
Figure 4:
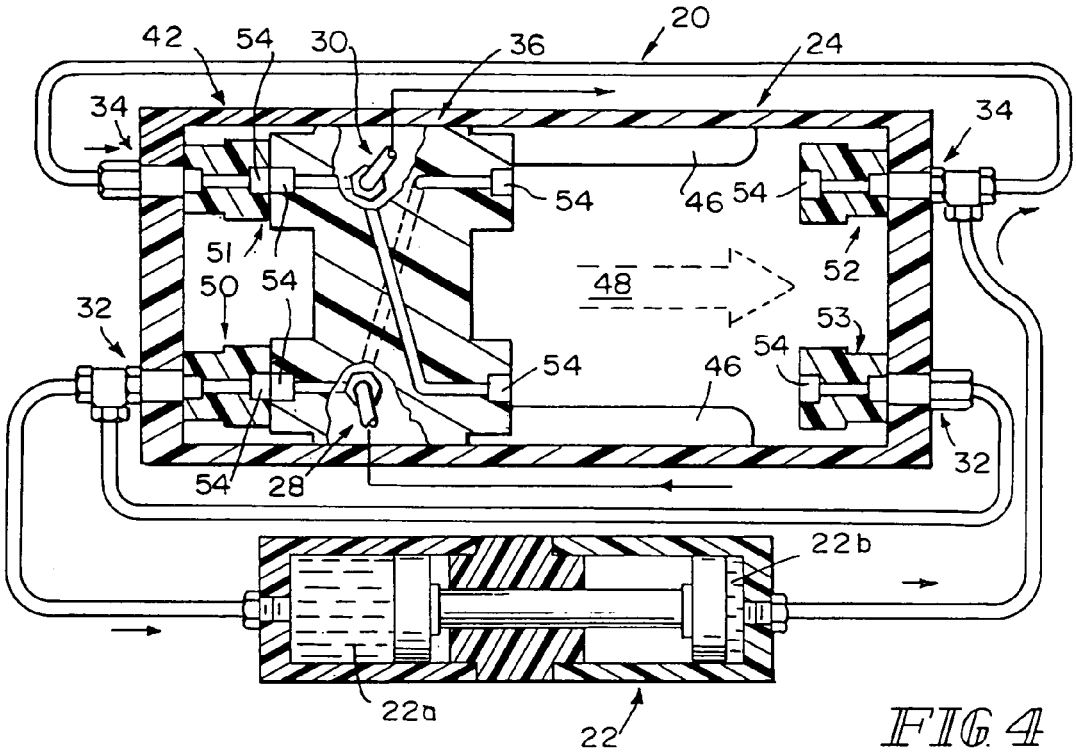
FIG. 4 illustrates a partly sectional view of the components illustrated in FIGS. 2-3, taken generally along section lines 4, 5-4, 5 of FIG. 3, in a first position; and, FIG. 5 illustrates a partly sectional view of the components illustrated in FIGS. 2-4, taken generally along section lines 4, 5-4, 5 of FIG. 3, in a second position.
Figure 5:
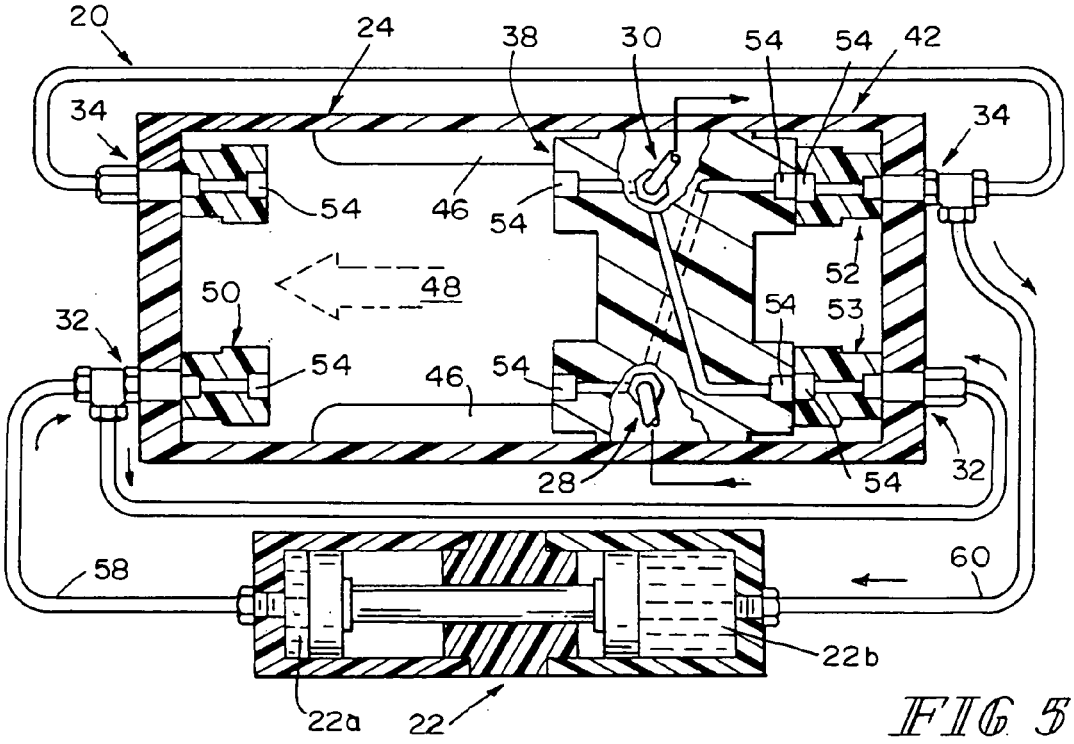

Referring now first to FIG. 1, an electrostatic coating system 10 comprises a coating dispensing device 12, such as, for example, one of the general type illustrated in any of the above-identified patents and published applications. Coating dispensing device 12 is coupled to a source 14 of high magnitude electrostatic potential in the range of, for example, −35 KVDC to −110 KVDC. Source 14 illustratively is one of the general type illustrated and described in U.S. Pat. Nos. 6,562,137; 6,423,142; 6,144,570; 5,978,244; 5,159,544; 4,745,520; 4,485,427; 4,481,557; 4,324,812; 4,187,527; 4,075,677; 3,894,272; 3,875,892; and, 3,851,618. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

A source 16 of coating material to be dispensed and an object 18 to be coated by the dispensed coating material are both coupled to reference potential, hereinafter sometimes ground. The source 16 typically includes means, such as a pump or compressed air source, for supplying the coating material at a desired pressure. The coating material itself will typically be an electrically non-insulative, for example, water-base, coating material, requiring that a voltage block be placed in the circuit between the coating material source 16 and the coating dispensing device 12 coupled to potential source 14. The source 16 is coupled through a voltage block 20 according to the invention to the dispensing device 12.

Referring now more particularly to FIGS. 2-5, the voltage block 20 includes a double-acting, piston-and-cylinder fluid motor 22 defining first and second reservoirs 22*a* and 22*b*, and a switching device 24. Switching device 24 includes an inlet port 28, an outlet port 30, and first and second reservoir ports 32, 34. Switching device 24 is selectively movable between a first position 36 illustrated in FIGS. 2-4 in which inlet port 28 is coupled to first reservoir port 32 and second reservoir port 34 is coupled to outlet port 30, and a second position 38 illustrated in FIG. 5 in which inlet port 28 is coupled to second reservoir port 34 and first reservoir port 32 is coupled to outlet port 30. The construction and operation of reservoirs 22*a-b* and switching device 24 may be generally as illustrated and described in WO 2005/014178.

The switching device 24 is itself mounted in a reservoir 40 illustrated in FIGS. 2-3. Reservoir 40 is constructed from electrically non-conductive material such as, for example, filled or unfilled resin or polymer material. Illustratively, fluid motor 22, switching device 24 and reservoir 40 are all constructed from a suitable electrically non-conductive, filled or unfilled Delrin® acetal resin. Switching device 24 may contain some metallic elements. For example, various valves of the switching device 24 may have some metal components. However, by virtue of such metal components being mounted in a suitable electrically non-conductive housing, they are electrically isolated or floating. Reservoir 40 illustratively is a box-shaped tank 42 covered by a lid 44.

The switching device 24 is mounted adjacent the floor 48 of the tank 42, for example, on (a) track(s), rail(s) or other guide means 46, for movement between the first and second positions 36, 38, respectively. In first position 36, switching device 24 engages and seals port 28 provided in switching device 24 to port 32 provided in a first valve block 50 adjacent one limit of travel of switching device 24, and seals port 34, provided in a second valve block 51, to port 30 provided in switching device 24. In the second position 38, switching device 24 engages and seals port 28 provided in switching device 24 to port 34 provided in a third valve block 52 adjacent the other limit of travel of switching device 24, and seals port 32, provided in a fourth valve block 53, to port 30 provided in switching device 24. Flow of coating material through ports 28, 30, 32, 34 in switching device 24 and valve blocks 50, 51, 52, 53 is controlled by engage-to-open/disengage-to-close valves 54, such as, for example, the quick couplers of the AquaBlock Mk II voltage block available from Ransburg Industrial Finishing Kabushiki Kaisha, 1-15-5, Fuku-Ura 1 Chome, Kanazawa-Ku Yokohama, Japan 236-0004, the disclosure of which is hereby incorporated herein by reference. This listing is not intended to be a representation that a complete search of all relevant art has been made, or that no more pertinent art than that listed exists, or that the listed art is material to patentability. Nor should any such representation be inferred.

Plumbing for the switching device 24 includes a conduit 56, a conduit 58, a conduit 60, and a conduit 62. Conduit 56 couples the source 16 and port 28. Conduit 58 couples reservoir 22*a* and port 32. Conduit 60 couples reservoir 22*b* and port 34. Conduit 62 couples port 30 and dispensing device 12.

Switching device 24 is moved back and forth between the first 36 and second 38 positions by a controller 64 which controls a motor or actuator means 66 such as, for example, a double-acting, piston-and-cylinder fluid motor. Motor 66 includes an output shaft 68 which is coupled via a tang 70 to switching device 24. Tang 70 extends between means 66 and switching device 24 through an elongated, slot-shaped opening 72 provided through lid 44. Elongated, slot-shaped openings 74, 76 are also provided through lid 44 for conduits 56 and 62 to accommodate the motion of switching device 24. Conduits 56 and 62 are flexible to accommodate this motion.

In operation, reservoir 40 is filled to a level above ports 28, 30, 32, 34, and typically to within a few centimeters of the top edge of tank 42, with a blocking medium, such as, for example, the blocking media described in U.S. Pat. Nos. 5,632,816; 5,787,928; 5,746,831; and, 5,944,045. The switching device is moved to its first position 36 and coating material is provided from the source 16 through conduit 56 to port 28, and through the switching device 24, port 32 and conduit 58 to reservoir 22*a*. Controller 64 and motor 66 then switch device 24 to its second position 38. Coating material is provided from source 16 through conduit 56, port 28, switching device 24, port 34 and conduit 60 to reservoir 22*b*. As reservoir 22*b* is being filled, reservoir 22*a* is being emptied through port 32, switching device 24, port 30 and conduit 62, supplying coating material to the dispensing device 12 from which the coating material is dispensed, coating article 18. As reservoir 22*a* reaches empty, controller 64 and motor 66 switch device 24 back to its first position in which coating material is provided from the source 16 through conduit 56, port 28, switching device 24, port 32 and conduit 58 to reservoir 22*a*. As this is occurring, reservoir 22*b* is being emptied, supplying coating material through conduit 60, port 34, switching device 24, port 30 and conduit 62 to dispensing device 12 from which the coating material is dispensed, coating article 18, and so on.

Referring particularly to FIG. 3, the reservoir 40 can include molecular sieves 80 such as, for example, those described in the above identified U.S. Pat. Nos. 5,944,045; 5,787,928; 5,746,831; and, 5,632,816. Illustratively, molecular sieves 80 are placed on the floor 48 of the reservoir 40 underneath switching device 24. The sieves 80 can be recycled and/or replenished as necessary to maintain their drying action on any water or the like which finds its way into the blocking medium in tank 42.

What is claimed is:

1. A voltage block comprising first and second reservoirs, a switching device including an inlet port, an outlet port, a first reservoir port and a second reservoir port, the switching device mounted for movement between a first position and a second position in a third reservoir, the third reservoir including an electrically non-conductive fluid medium in which at least a portion of the switching device is immersed.

2. The voltage block of claim 1 including a first valve, a second valve, a third valve and fourth valve, the first, second, third and fourth valves immersed in the electrically non-conductive fluid medium.

3. The voltage block of claim 1 wherein the first and second reservoirs comprise piston-and-cylinder fluid motors.

4. The voltage block of claim 3 wherein the first and second reservoirs together comprise a double-acting, piston-and-cylinder fluid motor.

5. The voltage block of claim 1 wherein the third reservoir comprises a tank including a track to which the switching device is mounted for movement between the first and second positions.

6. The voltage block of claim 5 wherein, when the switching device is in the first position, the first valve couples the inlet port to the first reservoir port and the second valve couples the second reservoir port to the outlet port, and when the switching device is in the second position, the third valve couples the inlet port to the second reservoir port and the fourth valve couples the first reservoir port to the outlet port.

7. The voltage block of claim 1 wherein the third reservoir includes means for movably mounting the switching device, the voltage block further including means for moving the switching device between the first and second positions.

8. The voltage block of claim 1 further comprising molecular sieves in the third reservoir.

9. The voltage block of claim 8 wherein the molecular sieves are renewable.

10. In combination, a coating material source, a coating dispensing device, a high magnitude electrostatic potential source, a voltage block comprising first and second reservoirs, a switching device including an inlet port, an outlet port, a first reservoir port and a second reservoir port, the switching device mounted for movement between a first position and a second position in a third reservoir, the third reservoir including an electrically non-conductive fluid medium in which at least a portion of the switching device is immersed, a conduit for coupling the coating material source and the inlet port, a conduit for coupling the first reservoir and first reservoir port, a conduit coupling the second reservoir and second reservoir port, and a conduit coupling the outlet port and the coating dispensing device.

11. A method of coating an article comprising providing first and second reservoirs, providing a switching device, providing on the switching device an inlet port, an outlet port, a first reservoir port and a second reservoir port, providing a third reservoir including an electrically non-conductive fluid medium, mounting the switching device in the third reservoir for movement between a first position and a second position, and at least partially immersing the switching device in the electrically non-conductive fluid medium in the third reservoir.

12. The method of claim 11 wherein providing a switching device and providing a third reservoir together include providing first, second, third and fourth valves, and at least partially immersing the switching device in the electrically non-conductive fluid medium in the third reservoir includes immersing the first, second, third and fourth valves in the electrically non-conductive fluid medium.

13. The method of claim 11 wherein providing first and second reservoirs comprises providing piston-and-cylinder fluid motors.

14. The method of claim 13 wherein providing first and second reservoirs together comprises providing a double-acting, piston-and-cylinder fluid motor.

15. The method of claim 11 wherein providing the third reservoir comprises providing a tank including a track and providing the switching device includes mounting the switching device on the track for movement between the first and second positions.

16. The method of claim 15 including coupling the inlet port to the first reservoir port through the first valve and coupling the second reservoir port to the outlet port through the second valve when the switching device is in the first position, and coupling the inlet port to the second reservoir port through the third valve and coupling the first reservoir port to the outlet port through the fourth valve when the switching device is in the second position.

17. The method of claim 11 further including movably mounting the switching device and moving the switching device between the first and second positions.

18. The method of claim 11 further including providing a coating material source, a coating dispensing device, a high magnitude electrostatic potential source, coupling the coating material source and the inlet port, coupling the first reservoir and first reservoir port, coupling the second reservoir and second reservoir port, and coupling the outlet port and the coating dispensing device.

19. The method of claim 11 further comprising providing molecular sieves in the third reservoir.

20. The method of claim 19 further comprising renewing the molecular sieves.

* * * * *